United States Patent [19]

Harada et al.

[11] Patent Number: 4,894,932

[45] Date of Patent: Jan. 23, 1990

[54] AIR-PERMEABLE SHOE

[75] Inventors: Masasuke Harada, Kurume; Yutaka Kumagawa, Chikugo; Yoshiharu Moronaga, Kitashigeyasu, all of Japan

[73] Assignee: Nippon Rubber Co., Ltd., Tokyo, Japan

[21] Appl. No.: 152,374

[22] Filed: Feb. 4, 1988

[30] Foreign Application Priority Data

Feb. 4, 1987 [JP] Japan ..... 57-15678

[51] Int. Cl.[4] ..... A43B 7/06; A43B 13/12

[52] U.S. Cl. ..... 36/3 R; 36/3 B; 36/29; 36/30 R

[58] Field of Search ..... 36/3 R, 3 A, 28, 29, 36/30 R, 32 R, 30 A, 44; 128/588

[56] References Cited

U.S. PATENT DOCUMENTS

| | | | |
|---|---|---|---|
| 2,224,590 | 12/1940 | Bolvin | 36/3 R |
| 2,239,211 | 4/1941 | Wylie . | |
| 2,720,041 | 10/1955 | Kajtar . | |
| 2,983,056 | 5/1961 | Murawski . | |
| 2,985,971 | 5/1961 | Murawski . | |
| 3,060,599 | 10/1962 | Okuyama | 36/3 R |
| 4,000,566 | 1/1977 | Famolare, Jr. . | |
| 4,078,321 | 3/1978 | Famolare, Jr. . | |
| 4,377,041 | 3/1983 | Alchoermes | 36/30 R |
| 4,438,573 | 3/1984 | McBarron | 36/3 B |
| 4,461,099 | 7/1984 | Bailly | 36/44 |
| 4,481,726 | 11/1984 | Phillips | 36/30 R |
| 4,551,930 | 11/1985 | Graham et al. | 36/30 R |
| 4,617,745 | 10/1986 | Batra | 36/3 B |
| 4,624,061 | 11/1986 | Wezel et al. | 36/30 A |

FOREIGN PATENT DOCUMENTS

| | | | |
|---|---|---|---|
| 3524421 | 1/1987 | Fed. Rep. of Germany | 36/32 R |
| 38-21285 | 10/1963 | Japan . | |
| 62-101203 | 5/1987 | Japan | 36/32 R |
| 63-57648 | 3/1988 | Japan . | |
| 2183536 | 6/1987 | United Kingdom | 36/28 |

*Primary Examiner*—James Kee Chi

*Attorney, Agent, or Firm*—Birch, Stewart, Kolasch & Birch

[57] ABSTRACT

An air-permeable shoe including a shoe constructed of an open-cell rubber foam. A base cloth is attached to the sole or insert therein. The sole of the shoe is exposed on a side surface of the sole of the shoe wherein a top side surface of the sole is in communication with the inside of the shoe and the ambient atmosphere. The open-cell rubber foam may be a rubber latex foam having a microstructure with a compression permanent set of less than 20%.

14 Claims, 4 Drawing Sheets

FIG. 6
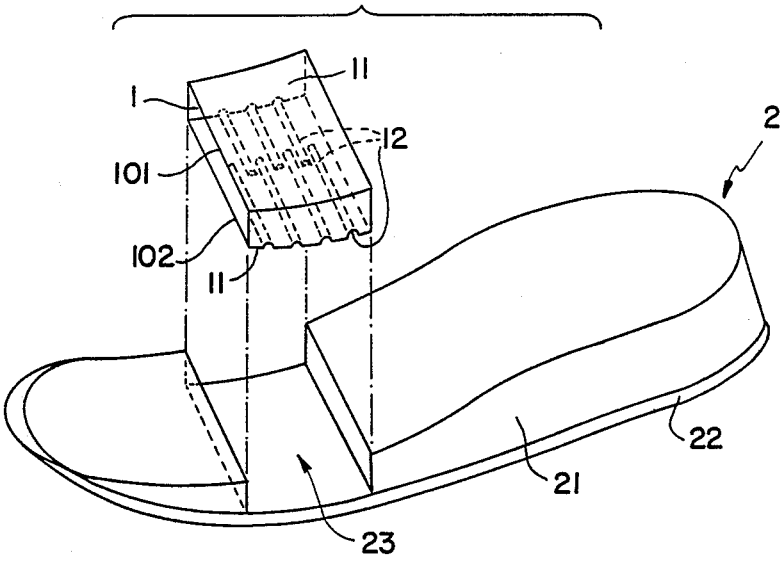
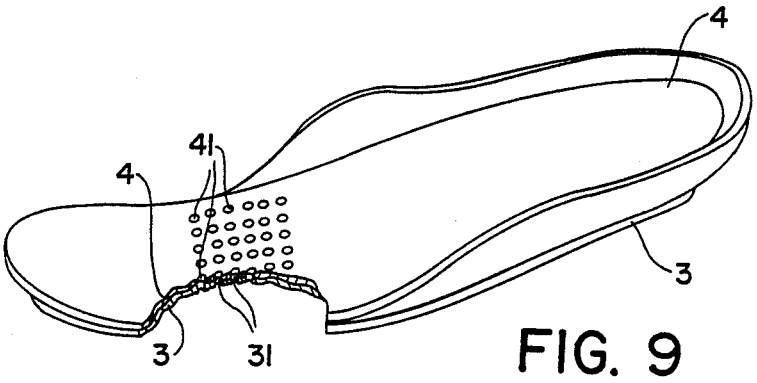
FIG. 9

AIR-PERMEABLE SHOE

BACKGROUND OF THE INVENTION

1. Field of the Invention

This invention relates to an air-permeable shoe.

2. Description of Background Art

Hithertofore, an air-permeable shoe sole having an open-cell rubber foam inset therein has been proposed as set forth in Japanese Patent Publication No. 21285-1963. This sole incorporates a side surface of rubber foam which is exposed on a side surface of the sole. Because an open-cell rubber foam is combined with an air-permeable member of structure present in this shoe, air within the shoe can be discharged from the inside of the shoe to a side surface of the sole. However, in a conventional type of air-permeable shoe, a disadvantage occurs when the humidity within the shoe rises due to wearing the shoe for a long period of time or due to high humidity in the ambient atmosphere such as occurs on a rainy day. Water, which forms from moisture and in turn condenses, clogs up the open cells of the open-cell rubber foam to cause the air permeability thereof to become considerably reduced.

In addition, open-cell rubber foam is weak in mechanical properties such as tension strength, internal tearing resistance and bending resistance characteristics. Thus, open-cell rubber foam presents a durability problem when used as a component material of a sole.

OBJECTS AND SUMMARY OF THE INVENTION

The present invention provides an air-permeable shoe adapted to maintain good air permeability even under high humidity conditions. Concurrently, the present invention provides a sole featuring an excellent durability.

An air-permeable shoe of the present invention is characterized in that an open-cell rubber foam includes a base cloth attached to or insetted into a sole in such a manner that it may be exposed on a side surface of the sole with a top side surface which may be in communication with the inside of the shoe.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 6 is a perspective view of a sole illustrating how an open-cell rubber foam with a base cloth attached to each of the top-side and underside surfaces thereof is inset in the tread portion of the sole according to the present invention;

FIG. 9 is a perspective view of the midsole with the core sole, partially cut away, illustrating vent holes provided therein.

DETAILED DESCRIPTION OF THE PREFERRED EMBODIMENTS

Figure 1:
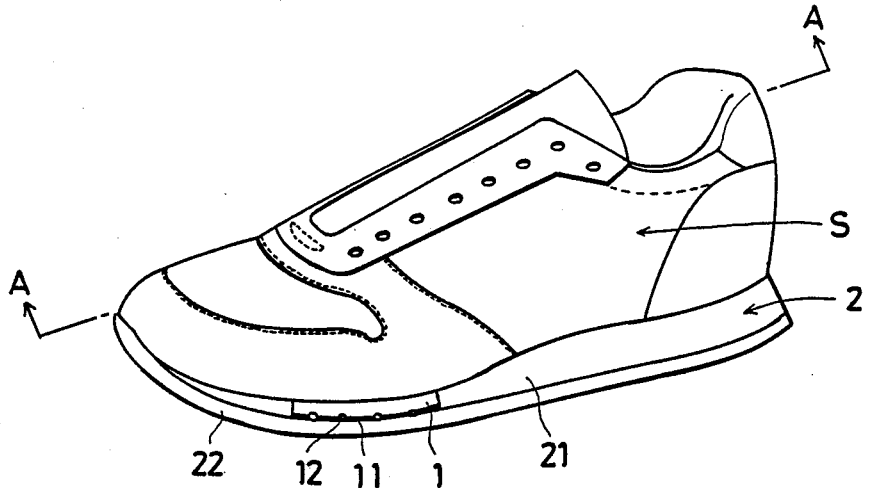
FIG. 1 is a perspective view of an embodying example of an air-permeable shoe according to the present invention.

An embodiment of the present invention will now be explained with reference to the accompanying drawings as follows.

An open-cell rubber foam material 1 includes a base cloth 11 attached thereto or inset therein. The open-cell rubber foam is inset in a sole 2 in such a manner that it is exposed on a side surface of the sole with a top side surface 101 being in communication with the inside of a shoe S.

The open-cell rubber foam 1 may be constructed from a rubber latex foam or an ordinary open-cell rubber foam. A more desirable type of foam material is one made of an open-cell rubber foam having a microstructure with a compression permanent set of less than 20% (according to JIS K6301). For example, as proposed in Japanese Patent Application No. 202844-1986, an open-cell rubber foam having a microstructure is obtained by combining for each 100 parts by weight of an ordinary rubber, 3 to 50 parts by weight of liquid polyisoprene rubber, 1 to 20 parts by weight of 5–50 micron powdered, low-density polyethylene, and a suitable amount of each of a foaming agent, a linking agent and other ordinary compounding ingredients for rubber. The ingredients are then mixed at a temperature lower than the softening temperature of a low-density polyethylene powder to form a non-vulcanized rubber material. This rubber material is heat treated for foaming and linking.

If the compression permanent set is more than 20%, wearing the shoe for a long period of time results in deterioration of the elastic restitution of the rubber foam and consequently in deterioration of cushion characteristic thereof. This makes the shoe less comfortable to wear and at the same time tends to reduce the air-permeability thereof due to lowering of its pumping action resulting from the lowered cushion characteristic of the rubber foam.

A base cloth 11 attached to or inset in the opencell rubber foam 1 under the present invention may be a woven, knitted or nonwoven fabric made of natural fibers such as cotton fibers, regenerated fibers such as rayon, Cupra (cuprammonium rayon), semi-synthetic fibers such as acetate fibers, or synthetic fibers such as polyamide fibers, polyvinyl alcohol fibers, polyester fibers, polyacrylic fibers or the like.

Figure 3:
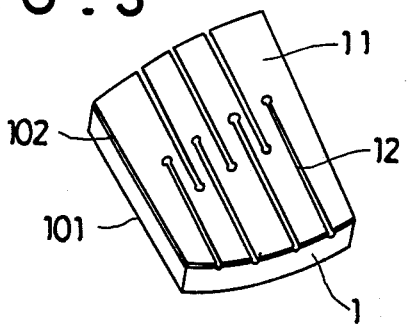
FIG. 3 is a perspective view of the open-cell rubber foam with a base cloth.
Figure 4:
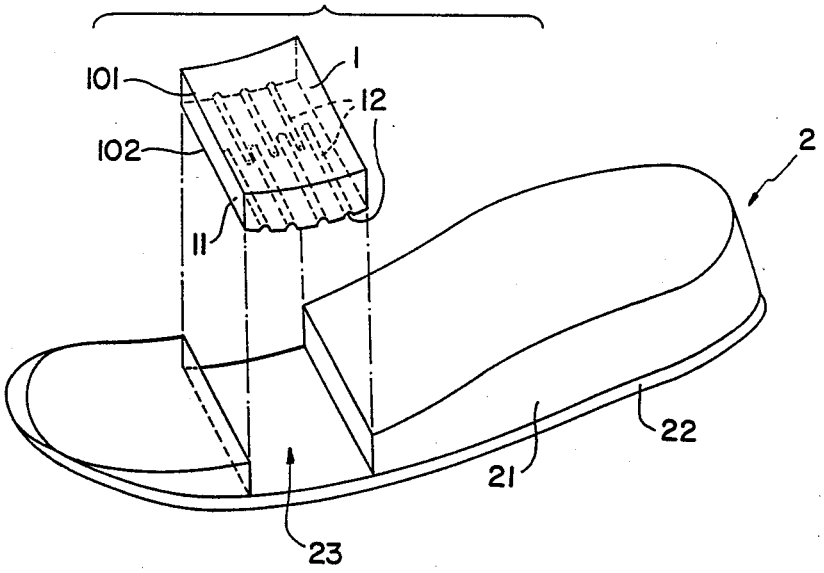
FIG. 4 is a perspective view of a sole illustrating how an open-cell rubber foam with a base cloth attached to the underside surface thereof is inset in the thread portion of the sole according to the present invention.
Figure 5:
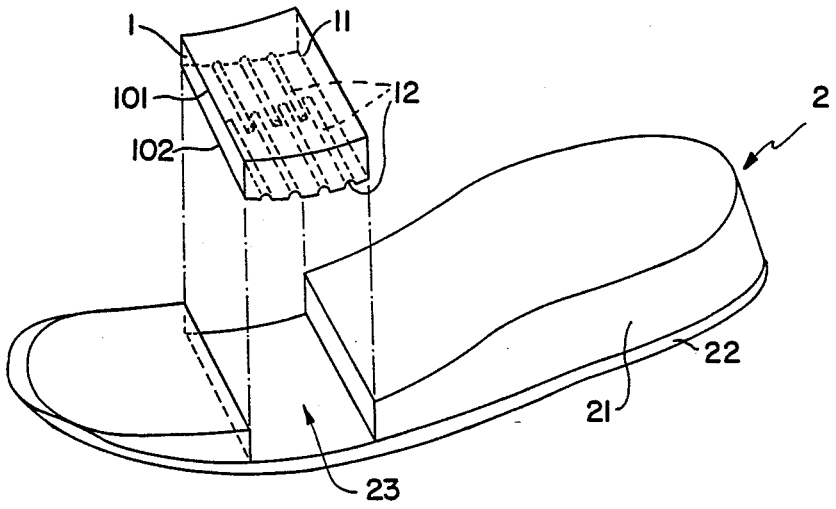
FIG. 5 is a perspective view of a sole illustrating how an open-cell rubber foam with a base cloth attached to the top-side surface thereof is inset in the tread portion of the sole according to the present invention.

FIG. 3 illustrates the base cloth 11 attached only to an underside surface 102 of an open-cell rubber foam 1. In addition, as illustrated in FIG. 5, the base cloth may be attached only to a top side surface 101 of the rubber foam 1. Further, as illustrated in FIG. 6, the base cloth 11 may be attached to both the underside and the top side surfaces 102, 101 thereof. It may also be inset in the rubber foam.

Figure 7:
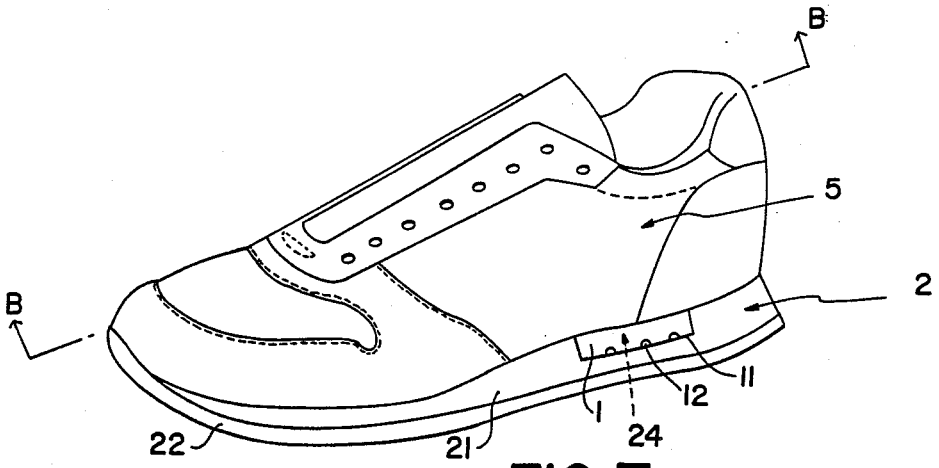
FIG. 7 is a perspective view of a shoe having an open-cell rubber foam inset in the heel portion of the sole.
Figure 8:
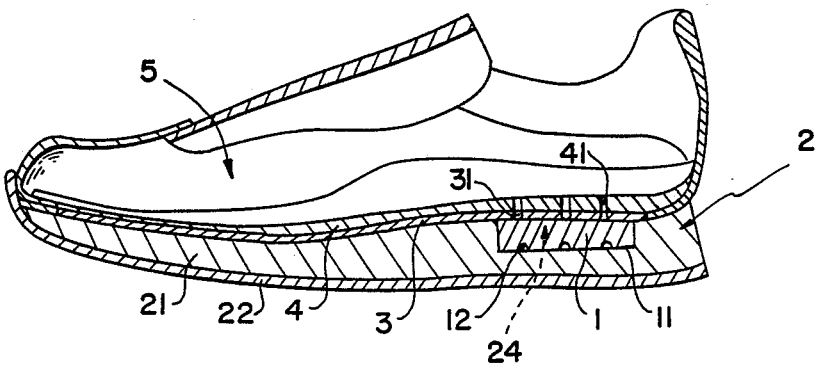
FIG. 8 is a sectional view taken along the line B—B in FIG. 7.

The open-cell rubber foam 1 having the base cloth 11 attached thereto or inset therein is then inset in a suitable portion such as the tread portion, as illustrated in FIGS. 1, 2, 4, 5 and 6, or the heel portion, as illustrated in FIGS. 7 and 8, of the sole 2 including an intermediate sole 21, an outsole 22, etc. When, as shown in the drawings, the rubber foam is to be inset in a portion of the sole 2 such as a tread portion 23 thereof which is subject to bending during use of the shoe, it is provided with grooves 12, 12 for bending which are arranged along the bending direction so that their side ends may open in a side surface of the sole, thus permitting the sole to be bent easily for smooth walking and running and at the same time further facilitating ventilation by the bending action of the grooves 12, 12 during use of the shoe.

Figure 2:
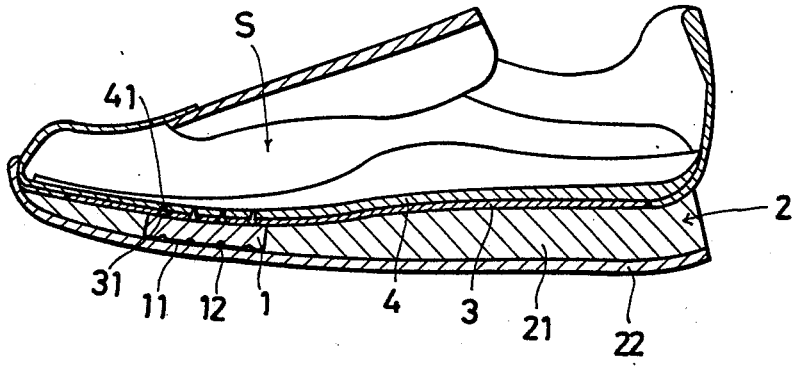
FIG. 2 is a sectional view taken along the line A—A in FIG. 1.

If the rubber foam 1 of the foregoing structure with the base cloth 11 is inset in a suitable portion of the sole 2 such as the intermediate sole 21, the outsole 22 or the like so that its top side surface is buried under a core sole 3 and a mid-sole 4 as shown in FIGS. 2 and 9, the top side surface 101 thereof is made to communicate with the inside of the shoe S through vent holes 31,. . ., 41. . . provided, respectively, in the soles 3 and 4.

With a shoe having the sole constructed as described above, even when humidity inside the shoe becomes high during use of the shoe for a long period of time or on a rainy day, the moisture reaching the base cloth 11 of the open-cell rubber foam 1 is discharged successively to the side surfaces of the sole 2 by capillary action.

Therefore, the open cells of the open-cell rubber foam are free from being clogged with water formed from moisture which condenses so that the shoe can maintain good air permeability even under high humidity conditions. In addition, since the open-cell rubber foam 1 has the base cloth 11 attached thereto or inset therein, tension strength, internal tearing resistance and bending resistance characteristic are improved, so that the durability of the sole is remarkably increased as compared with a conventional sole.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An air-permeable shoe comprising:

a sole constructed of an open-cell rubber foam; and a base cloth attached to said sole or inset therein;

said sole and said base cloth of the shoe being exposed on a side surface of the sole of the shoe wherein a top side surface of said sole is in communication with the inside of the shoe and the ambient atmosphere for enabling air and humidity within said shoe to be discharged through the open-cell rubber foam and the side surface of the sole by a capillary action.

2. An air-permeable shoe according to claim 1, wherein said open-cell rubber foam is a rubber latex foam.

3. An air-permeable shoe according to claim 1, wherein said open-cell rubber foam has a microstructure with a compression permanent set of less than 20%.

4. An air-permeable shoe according to claim 1, wherein said base cloth is a woven, knitted or nonwoven fabric selected from the group consisting of natural fibers such as cotton fibers, regenerated fibers such as rayon, Cupra or cuprammonium rayon, semi-synthetic fibers such as acetate fibers or the like, or synthetic fibers such as polyamide fibers, polyvinyl alcohol fibers, polyester fibers, and polyacrylic fibers.

5. An air-permeable shoe according to claim 1, wherein said base cloth is attached onto the top side surface of the open-cell rubber foam.

6. An air-permeable shoe according to claim 1, wherein said base cloth is attached onto the underside surface of the open-cell rubber foam.

7. An air-permeable shoe according to claim 1, wherein said base cloth is attached onto both the top side surface and the underside surface of the open-cell rubber foam.

8. An air-permeable shoe according to claim 1, wherein said base cloth is inset in the open-cell rubber foam.

9. An air-permeable shoe according to claim 1, wherein said open-cell rubber foam is inset in an intermediate sole of the shoe.

10. An air-permeable shoe according to claim 1, wherein said open-cell rubber foam is inset so as to extend from the intermediate sole to an outsole of the shoe.

11. An air-permeable shoe according to claim 1, wherein said open-cell rubber foam is inset in a tread portion of the sole of the shoe.

12. An air-permeable shoe according to claim 1, wherein said open-cell rubber foam is inset in a heel portion of the sole of the shoe.

13. An air-permeable shoe according to claim 1, wherein the top side surface of said open-cell rubber foam is in communication with the inside of the shoe through vent holes provided, respectively, in a core sole and a mid-sole of the shoe.

14. An air-permeable shoe according to claim 1, wherein said open-cell rubber foam is provided with grooves for bending which open in a side surface of the sole of the shoe.

* * * * *

UNITED STATES PATENT AND TRADEMARK OFFICE

CERTIFICATE OF CORRECTION

PATENT NO. : 4,894,932

DATED : January 23, 1990

INVENTOR(S) : Masasuke HARADA, Yutaka KUMAGAWA, and Yoshiharu MORONAGA

It is certified that error appears in the above—identified patent and that said Letters Patent is hereby corrected as shown below:

Title page, in the Heading, under (30) Foreign Application Priority Data, change "Feb. 4, 1987 (JP) Japan..... 57-15678"

to

-- Feb. 4, 1987 (JP) Japan ..... 62-15678 --

Signed and Sealed this

Eleventh Day of June, 1991

*Attest:*

*Attesting Officer*

HARRY F. MANBECK, JR.

*Commissioner of Patents and Trademarks*